US005114278A

United States Patent [19]

Locotos et al.

[11] Patent Number: 5,114,278

[45] Date of Patent: May 19, 1992

[54] MINING BOLT APPARATUS AND METHOD

[75] Inventors: Frank M. Locotos, Bridgeville; Robert S. Bechtold, Pittsburgh, both of Pa.

[73] Assignee: F. M. Locotos Equipment & Design Co., McMurray, Pa.

[21] Appl. No.: 771,523

[22] Filed: Oct. 4, 1991

Related U.S. Application Data

[63] Continuation of Ser. No. 489,697, Mar. 7, 1990, abandoned.

[51] Int. Cl.[5] ..... E21D 20/02

[52] U.S. Cl. ..... 405/259.6; 405/259.1; 411/411

[58] Field of Search ..... 405/261, 260, 259; 411/411, 417, 418, 426, 386, 387, 383; 52/698, 704

[56] References Cited

U.S. PATENT DOCUMENTS

| | | | |
|---|---|---|---|
| 2,696,137 | 12/1954 | Thomas et al. | 405/259 X |
| 2,823,574 | 2/1958 | Rosan | 411/386 |
| 3,073,207 | 1/1963 | Lovisek | 411/411 |
| 3,129,963 | 4/1964 | Robbins | 411/411 X |
| 3,748,949 | 7/1973 | Dreger | 411/411 |
| 4,052,860 | 10/1977 | Alterman | 405/259 |
| 4,293,243 | 10/1981 | Graybeal et al. | 405/259 |
| 4,301,847 | 11/1981 | Stickler | 411/411 X |
| 4,531,861 | 7/1985 | Kash | 405/259 X |
| 4,619,559 | 10/1986 | Norris | 405/259 |
| 4,662,795 | 5/1987 | Clark et al. | 405/260 X |

*Primary Examiner*—Randolph A. Reese
*Assistant Examiner*—J. Russell McBee
*Attorney, Agent, or Firm*—Ansel M. Schwartz

[57] ABSTRACT

A mining bolt for holding rock comprised of an elongate shaft at least a portion of which has threads. The threads directly thread into the rock and are capable of supporting the bolt under tension in the rock. The mining bolt is also comprised of a flange system disposed about the shaft in proximity to one end thereof such that when the shaft is threaded into the rock, the flange system abuts under tension the rock's face. A method for holding rock in a mine comprising the steps of drilling a bore hole into the rock; and inserting the shaft of a mining bolt into the bore hole. The shaft has a flange system disposed about the shaft in proximity to the end thereof. The shaft has threads and is of a length longer than the length of the bore hole. There is also the step of screwing the shaft into the rock at the top of the bore hole such that the threads of the shaft penetrate into the rock and the flange abuts under tension the rock face.

12 Claims, 4 Drawing Sheets

MINING BOLT APPARATUS AND METHOD

This is a continuation of copending application Ser. No. 07/489,697 filed on Mar. 7, 1990 now abandoned.

FIELD OF THE INVENTION

The present invention is related to mining bolts. More specifically, the present invention is related to a mining bolt having threads which is directly screwed into rock.

BACKGROUND OF THE INVENTION

In the mining industry, structural support to maintain a mine is typically attained with various types of mining bolts. These mining bolts can consist of various designs:

1. Mechanical bolts which have a smooth round shaft - a forged head and a bearing plate on one end, and an expansion anchor at the other. (Tensioned Bolt)

2. Fully grouted resin bolts which consist of a reinforcing bar with a forged head and bearing plate on one end. The rest of the reinforcing bar is left as is. These bolts are used with polyester resin cartridges to grout around the bar and fill the annulus between the bore hole and the reinforcing bar. (Untensioned Bolt)

3. Partially anchored tensioned bolt:

A. A partially anchored (polyester resin) reinforcing bar with a frangible delay nut of various design at the bottom end plus a bearing plate. (Tensioned Bolt) Referred to as a "Tension Rebar" Bolt.

B. A partially anchored (polyester resin) reinforcing bar that is threaded at its bottom portion and connected to a smooth bolt on the bottom plus a bearing plate. The reinforcing bar is grouted in polyester resin. The coupling that joins the rebar to the smooth bolt on the bottom has a delay mechanism to permit the resin to be mixed and subsequently allow take up in the coupling after the resin becomes hard. A typical bolt of this design is U.S. Pat. No. 4,477,209 entitled Combo Anchor®. (Tensioned Bolt)

C. A partially grouted smooth bolt that features a nut on the threaded top end to which is attached a mixing wire to mix the resin. The bottom end has a forged head, dual thrust washers, and a bearing plate. This is a tensioned bolt called the "Fastorq Bolt" TM patented by Dupont.

4. A grouping of bolts using either a headed reinforcing bar or a headed smooth bar with a bearing plate. At the top end is a mechanical anchor that is reinforced with polyester resin. (Tensioned Bolt) A typical bolt of this design is U.S. Pat. No. 4,655,645 entitled Spiral Bolt®.

5. A smooth headed bolt with a buttress deformation at the top end which screws into a compressible plastic formable material and a bearing plate at the bottom. A polyester resin cartridge can also be used to reinforce this anchorage with the plastic tube. (Tension Bolt) U.S. Pat. No. 4,659,295 called DYNA ROK TM Anchors.

6. A long tube of high strength steel, with a slot along its entire length. One end is tapered for insertion into a drilled hole in the roof of the mine. The other end has a welded ring flange to retain a roof plate. This bolt is driven into the hole. (Untensioned Bolt) named Split Set®.

7. A bolt that is manufactured from a steel tube. The tube has been mechanically reshaped to an outer diameter that is smaller. Bushings are pressed onto the ends, which are sealed through welding. The lower bushing is flanged to hold a bearing plate in place. A hole is drilled through the lower bushing and the wall of the tube to allow water to be injected into the bolt. During installation, the high pressure water causes the bolt to expand and forms it to irregularities in the drill hole. After installation, the water pressure is released. (untensioned) Bolt called Swellex®, manufactured by Atlas Copco Co.

8. Screwing a threaded bolt into set resin to attain a tensioned system such as the Clarich TM roof bolt.

All of the above bolts require a hole to be drilled into the roof and everything that occurs, as far as anchorage is concerned, is confined within the borehole. Contrary to the above examples, there is a bolt which requires no borehole for installation:

9. A bolt which is driven into the roof of a mine, requiring no borehole, similar to driving a nail into wood. This is called the Pin-Set Bolt®, U.S. Pat. No. 3,643,542; date of issue: Feb. 22, 1972. (Untensioned Bolt).

The present invention is a mining bolt which is directly screwed into the rock and a method with respect to the same. It may or may not be used with any amount of resin, be it a point anchor system or a fully grouted system. The need for delay mechanisms or expansion anchors is then eliminated to establish a bolt under tension in the rock.

SUMMARY OF THE INVENTION

The present invention pertains to a mining bolt for holding rock. The mining bolt is comprised of an elongate shaft at least a portion of which has threads. The threads directly penetrate into the rock and are capable of supporting the bolt under tension in the rock. The mining bolt is also comprised of a flange system disposed about the shaft in proximity to one end thereof such that when the shaft is threaded into the rock, the flange system abuts under tension the rock face.

The present invention pertains to a method for holding rock in a mine. The method comprises the steps of drilling a bore hole into the rock; and inserting the shaft of a mining bolt into the bore hole. The shaft has a flange system disposed about the shaft in proximity to the end thereof. The shaft has threads and is of a length longer than the length of the bore hole. There is also the step of screwing the shaft into the rock at the top of the bore hole such that the threads of the shaft penetrate into the rock and the flange system abuts under tension the rock face.

Alternatively, the method for holding rock in a mine comprises the step of drilling a bore hole into the rock. The bore hole has a first diameter in communication with the opening of the bore hole and a second diameter along the end of the bore hole opposite the opening. Additionally, there is the step of inserting the shaft of the mining bolt into the bore hole. The shaft has a flange system disposed about the shaft in proximity to the end thereof and has threads. There is also the step of screwing the shaft into the rock along the second diameter of the bore hole such that the threads of the shaft penetrate into the rock and the flange system abuts under tension the rock face.

Alternatively, the method for holding rock in a mine comprises the step of placing the tip of a mining bolt in contact with the rock face. The mining bolt has a shaft having threads and a flange system disposed about the shaft in proximity to the end thereof. The tip is disposed at the other end of the shaft. There is also the step of screwing the mining bolt into the rock such that the threads of the shaft penetrate into the rock and the flange system abuts under ten ion the rock face.

BRIEF DESCRIPTION OF THE DRAWINGS

In the accompanying drawings, the preferred embodiments of the invention and preferred methods of practicing the invention are illustrated in which.

DESCRIPTION OF THE PREFERRED EMBODIMENT

Figure 1:
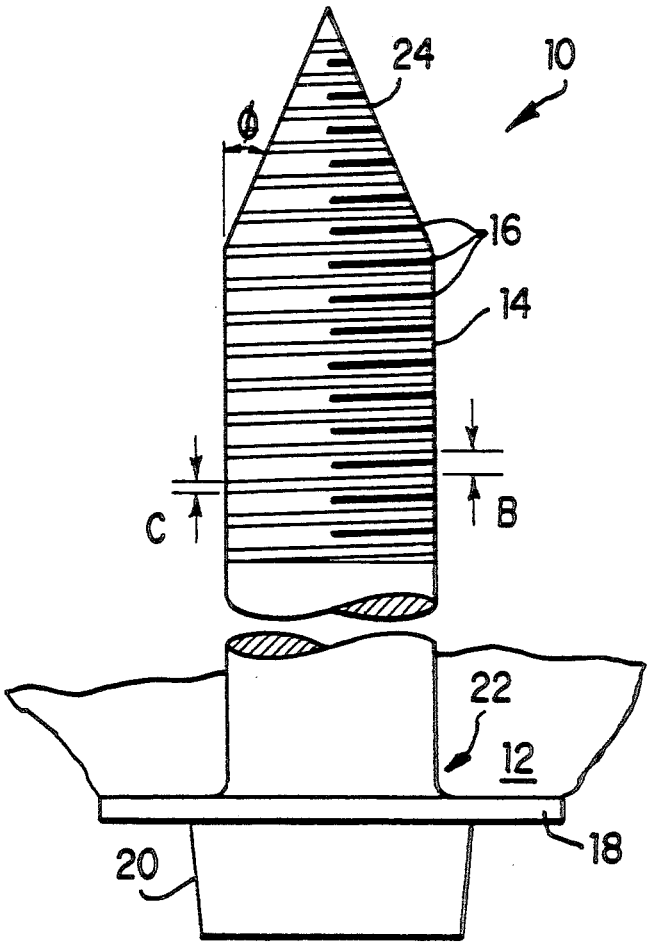
FIG. 1 is a side view of a portion of a mining bolt.

Referring to the drawings wherein like reference numerals refer to similar or identical parts throughout the several views, and more specifically, referring to FIG. 1 thereof, there is shown a mining bolt 10 for holding rock 12. The mining bolt 10 is comprised of an elongate shaft 14 at least a portion of which has threads, 16. The threads 16 penetrate directly into the rock 12 and are capable of supporting the bolt under tension in the rock. (Preferably, the bolt 10 can develop at least 3000 lbs. of force). Additionally, the mining bolt 10 is comprised of a flange system 18 positioned about the shaft 14 in proximity to one end 20 thereof such that when the shaft 14 is threaded into the rock 12, the flange system 18 abuts under tension the rock face 22. The rock encountered for anchorage can vary from very soft shales to harder combinations of sandy shales to sandstone but is not limited thereto. Note that the mining bolt 10 identified herein is also known in the industry as a roof bolt or a rock bolt.

Preferably, the other end 24 of the shaft 14 has threads and is tapered to facilitate penetration of the bolt 10 into the rock 12. The shaft 14 is preferably made out of grade 60 rebar, is between 6 inches and 25 feet in length and between 0.5 inches and 2 inches in diameter.

Figure 2:
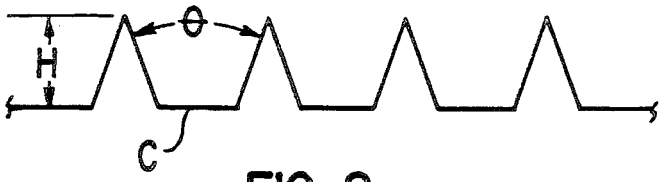
FIG. 2 is a cut away side view of a first embodiment of threads on the mining bolt.
Figure 3:
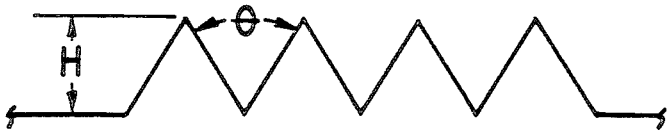
FIG. 3 is a cut away side view of a second embodiment of threads on the mining bolt.

The threads 16 on the shaft 14 are such that they can directly grip the rock 12 and support the installed load placed upon the bolt 10 in order to tension the bolt 10 into the rock 12. The threads 16 should be spaced apart so there is enough rock 12 between each thread 16 to sustain the forces applied to it through the threads 16 of the bolt 10 under tension in the rock 12. Preferably, there is a space C between the base of each thread 16, as shown in FIG. 2, so that there is more rock 12 between each thread 16. Possibly, the threads 16 having no space between their bases may be preferable because greater thread area per unit length of the shaft 14 is available, as shown in FIG. 3.

Preferably, the threads 16 are of a wood screw type. The threads 16 are pointed on one side A and wide on the other side B with a space C in between the threads. The pointed side A of the threads allow the threads to cut into the rock 12 and the wide side B is necessary in order for the threads to withstand shearing forces caused by tensioning the bolt 10 in the rock 12. Also, there must be a great enough thread height H and thread angle to create sufficient thread area to withstand the shearing forces.

Figure 4:
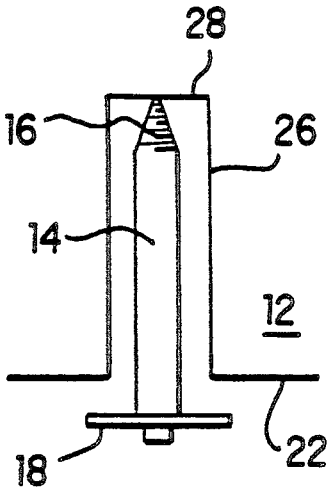
FIG. 4 is a schematic representation of a first embodiment of the mining bolt in rock.
Figure 6:
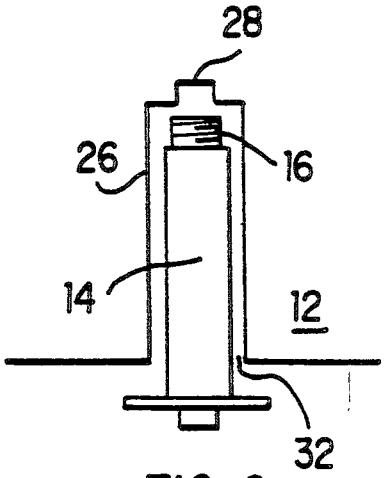
FIG. 6 is a schematic representation of a second embodiment of a mining bolt in rock.

The mining bolt 10 with threads 16 along the shaft 14 thereof is then placed in rock 12 by the steps of: drilling a bore hole 26 into the rock 12; inserting the shaft 14 of the mining bolt 10 into the bore hole 26; and screwing the shaft 14 into the rock 12 at the top 28 of the bore hole 26 such that the threads 16 of the shaft 14 penetrate into the rock 12 and the flange system 18 abuts under tension the rock face 22. The shaft 14 has threads 16 and is of a length longer than the length of the bore hole 26. See FIG. 4.

Figure 5:
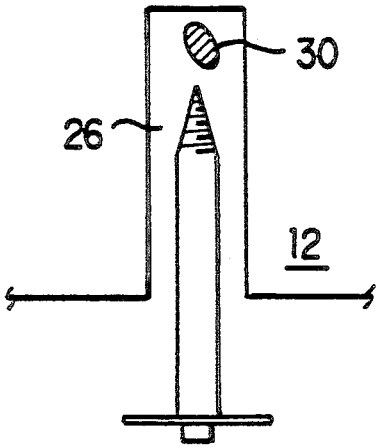
FIG. 5 is a schematic representation of a mining bolt and resin capsule in rock.

Preferably, before the step of inserting the shaft 14 into the bore hole 26, there is included the step of inserting a resin capsule 30, such as a polyester resin capsule which is well known in the art, into the bore hole 26. After the resin capsule 30 is inserted into the bore hole 26, as shown in FIG. 5, the shaft 14 of the mining bolt 10 is inserted into the bore hole 26 and, in the process of being screwed into the rock 12 at the top 28 of the bore hole 26, the resin capsule 30 is punctured and the resin therein mixed about the shaft 14 to fixedly connect the shaft 14 to the rock 12.

In an alternative embodiment, the mining bolt 10 is then placed in the rock 12 by the steps of: drilling a bore hole 26 into the rock 12. The bore hole 26 has a first diameter in communication with the opening 32 of the bore hole 26 and a second diameter along the top 28 of the bore hole 26 opposite the opening 32. Then there are the steps of inserting the shaft 14 of the mining bolt 10 into the bore hole 26 and screwing the shaft 14 into the rock 12 along the second diameter of the bore hole 26 such that the threads 16 of the shaft 14 penetrate into the rock 12 and the flange system 18 abuts under tension the rock face 22. A resin capsule 30 could also be used in this embodiment.

Figure 7:
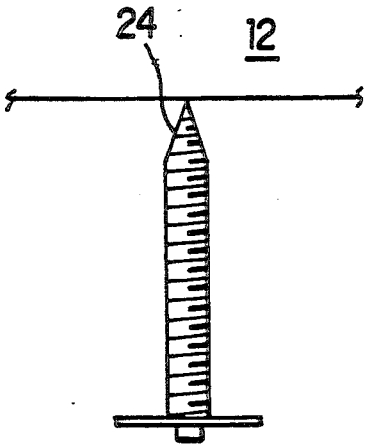
FIG. 7 is a schematic representation of a third embodiment of the mining bolt as it is being introduced into rock.

In another embodiment, the mining bolt 10 is then placed into rock 12 by the steps of placing the other end 24 of the mining bolt 10 in contact with the rock face 22 and screwing the mining bolt 10 into the rock 12 such that the threads 16 of the shaft 14 penetrate into the rock 12 and the flange 18 abuts under tension the rock face 22. The mining bolt 10 has a shaft 14 having threads 16, preferably along the entire length thereof. The shaft 14 also has the flange system 18 disposed about the shaft 14 in proximity to the end 20 thereof and the other end 24 is preferably tapered, as shown in FIG. 7.

Figure 8:
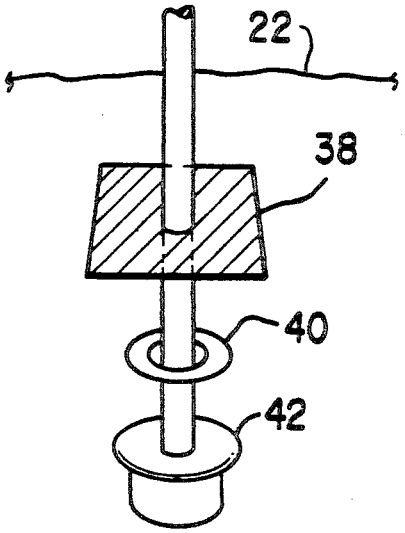
FIG. 8 is a schematic representation of a flange system.
Figure 9:
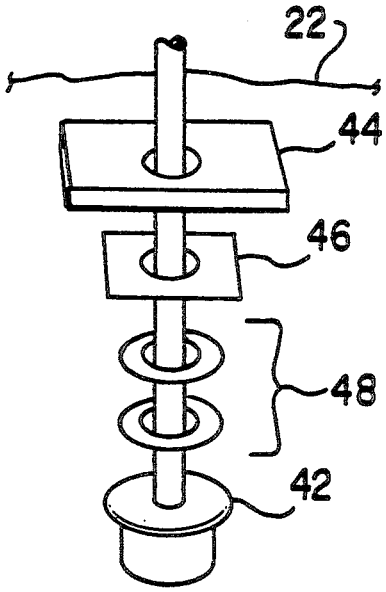
FIG. 9 is a schematic representation of an alternative embodiment of a flange system.

Preferably, the flange system 18 is composed of a plate 38 to contact the rock face 22, a separate washer 40, and a washer forged with the bolt head (as one piece) 42. The flange system 18 may be only the forged washer 42, as shown in FIG. 8. The flange system may also be a wooden or metal header plate 44, a bearing plate 46, multiple detached washer(s) 48, and the forged washer 42, as shown in FIG. 9, to name but a few of the possible designs.

In the operation of the preferred embodiment and as shown in FIG. 5 a bore hole 26 is first drilled into the rock 12. The rock can comprise the roof of the mine, or the rock can be a coal rib on the side of the mine, to mention but a few examples of where the bolt 10 can be placed. The bore hole 26 has a length of 48 inches. A resin capsule 30 is then inserted into the bore hole 26 followed by the shaft 14 of the mining bolt 10.

There is a flange system 18 disposed about the shaft 14 in proximity to one end 20 thereof. The flange system is a 6 inch by 6 inch by $\frac{3}{8}$ inch steel plate. There is a $\frac{3}{4}$ inch Frazer and Jones dome nut disposed about the end 20 of the shaft 14 to facilitate threading of the shaft into the rock by a roof bolting machine or a stopping machine.

The shaft 14 is 51 inches long and has a $\frac{3}{4}$ inch diameter. The shaft is made out of grade 60 rebar. The other end 24 of the shaft 14 is tapered with a thread skew angle of 15.6°. There are threads 16 extending $1\frac{3}{4}$ inches down the shaft 14 from the tip 24 of the shaft 14. There are 8.7 threads per inch. The threads 16 are of a wood screw type and are pointed on one side A and 0.052 inches wide on the other side B with a space C of 0.062 inches between the threads 16 resulting in a pitch of 0.114 inches. Each thread 16 has a thread height H of 0.045 inches and there is a thread angle of 60 degrees between each of the threads 16. The threads are spaced apart by a distance C such that there is enough rock 12 between the threads 16 to withstand the stress applied thereto from the threads 16 of the mining bolt 10.

After the shaft 14 and resin capsule 30 are in the bore hole 26, the other end 24 of the shaft 14 is raised to the top 28 of the bore hole 26 and in the process punctures the resin capsule 30. The mine bolt 10 is then rotated under low boom pressure to mix the resin. Boom pressure is then increased in order for the tip 24 of the shaft 14 to penetrate into the rock 12. As the boom pressure is increased in order for the tip 24 to penetrate the rock 12, full rotation is also applied to the mining bolt in order to accomplish the screwing of the threads 16 into the rock. The installation torque applied to the rock bolt is 210 foot pounds. The installation boom pressure applied to the rock bolt is 7,000 pounds.

The shaft 14 of the mining bolt 10 is screwed into the rock 12 at the top 28 of the bore hole 26 such that the flange system 18 abuts under tension the rock face 22. The screwing of threads 16 of the shaft 14 into the rock 12 on top of the bore hole 26 allows the mining bolt to remain in place without being externally held until the resin sets. The resin, once set, supplements the threads 16 in supporting the tensioned force on the mining bolt 10 with respect to the rock 12.

The mining bolt provides a quick mechanical anchorage, therefore requiring no supervision while the resin is hardening. The mechanical anchorage of the bolt does not require an expansion shell. The problem of spinners is thus eliminated. (This is when the mechanical bolt spins the expansion shell to the end of the threads, causing the shell not to anchor, thus rendering the bolt useless.)

Figure 10:
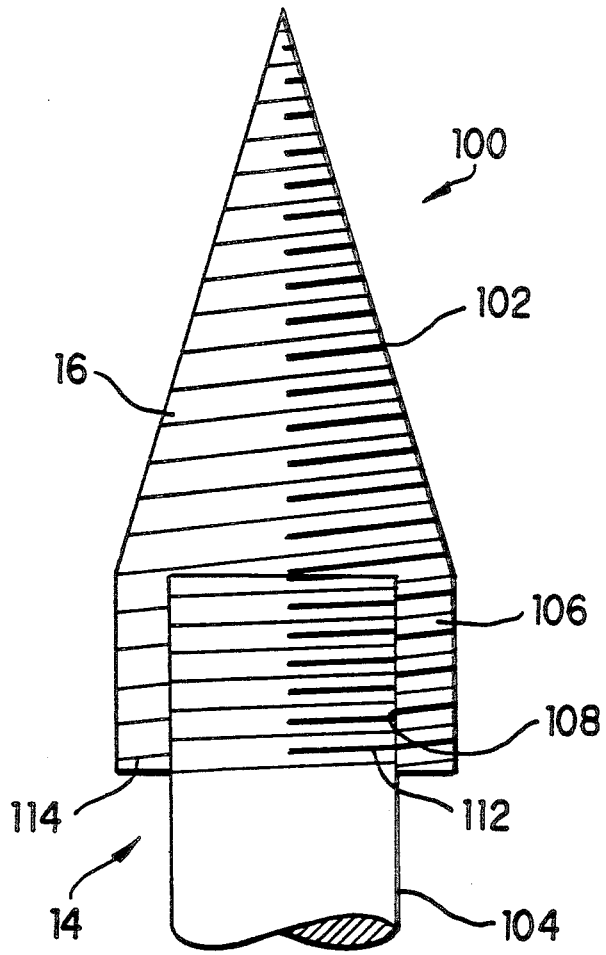
FIG. 10 is a schematic representation of a fourth embodiment of a mining bolt.

In another alternative embodiment, and as shown in FIG. 10, there is a portion of a mining bolt 100. The elongate shaft 14 of the mining bolt 100 includes a first part 102 having threading 16 which directly threads into the rock 12. The elongate shaft 14 of the mining bolt 100 also has a second part 104 which is fixedly attached to the first part 102 and to which the flange system 18 is disposed about. Preferably, 102 is tapered and the threadings 16 are the same as that described previously.

The first part 102 is preferably threadingly attached to the second part 104. For instance, the first part 102 can have a female threaded portion 106 and the second part 104 can, for instance, have a male threaded portion 108 which is received by the female threaded portion 106 of the first part 102 in order for the first part 102 and the second part 104 to be threadingly attached. The threading 16 of the first part 102 which directly threads into the rock 12 is different from the threading 112 of the male portion 108 to the second par 104.

In a preferred embodiment, for a three quarter inch diameter system the second part 104 made of grade 60 rebar has a male threaded portion 108 that is three quarters of an inch long. The female threaded portion 106 of the first part 102 is similarly three quarters of an inch long and is slightly tapered as opposed to flat at its end 114 in order to guide the second part 104 into the first part 102. The length of the tapered portion of the first part 102 is 2.5 inches and the length from the tapered part to the end 114 is $\frac{7}{8}$ of an inch. The diameter of the nontapered portion of the first part 102 is $1\frac{1}{4}$ inches. For a $\frac{5}{8}$ inch, $\frac{7}{8}$ inch or 1 inch rebar system, or other diameter system, these parameters vary in accordance with the overall design.

Although the invention has been described in detail in the foregoing embodiments for the purpose of illustration, it is 0 to be understood that such detail is solely for that purpose and that variations can be made therein by those skilled in the art without departing from the spirit and scope of the invention except as it may be described by the following claims.

What is claimed is:

1. A system for holding rock comprising:

a resin capsule which is placed in a bore hole in the rock;

a mining bolt comprised of an elongate shaft at leased a portion of which has threads, said threads fixedly nonmovably attached to the shaft, said threads directly penetrating into the rock along a top of the bore hole, said threads capable of supporting the bolt under tension in the rock, said shaft having a diameter smaller that the diameter of the bore hole such that when the shaft is inserted into the bore hole with the resin capsule therein, the resin capsule is punctured by the shaft and the resin flows down the bore hole in a space between the rock in which the bore hole is disposed and the shaft; and a flange system disposed about the shaft in proximity to a first end thereof such that when the shaft is threaded into the rock, the flange system abuts under tension the rock face.

2. A system as described in claim 1 wherein the shaft has a second end opposite the first end, and said second end of the shaft has threads.

3. A system as described in claim 2 wherein the second end is tapered.

4. A system as described in claim 3 wherein the elongated shaft is made of solid rebar.

5. A system as described in claim 3 wherein the shaft is between 6 inches and 25 feet in length and between 0.5 inches and 2 inches in diameter.

6. A system as described in claim 1 wherein the elongate shaft includes a first part having threading which directly penetrates into the rock; and a second part which is fixedly attached to the first part and to which the flange system is disposed about said second part having a diameter smaller that a diameter of the first part.

7. A system as described in claim 6 wherein the first part is tapered.

8. A system as described in claim 7 wherein the first part is threadingly attached to the second part.

9. A system as described in claim 8 wherein the first part has a female threaded portion and the second part has a male threaded portion which is received by the female threaded portion of the first part in order for the first part and the second part to be threadingly attached.

10. A system as described in claim 9 wherein the threading of the first part which directly penetrates into the rock is different from the threading of the male portion of the second part.

11. A method for holding rock in a mining comprising the steps of:

drilling a bore hole into the rock;

inserted a resin capsule into the bore hole;

inserting a shaft of a mining bolt into the bore hole, said shaft having a flange system disposed about the shaft in proximity to a first end thereof, said shaft having threads fixedly nonmovably attached to the shaft, said shaft being of a length longer than a length of the bore hole, said shaft having a diameter smaller than the diameter of the bore hole such that there is a space between the shaft and the rock in which the bore hole is disposed;

puncturing the resin capsule with shaft such that the resin flows down the bore hole in the space; and screwing the shaft into the rock at a top of the bore hole opposite the bore hole opening such that the threads of the shaft penetrate into the rock and the flange system abuts under tension the rock face.

12. A method for holding rock in a mine comprising the steps of:

drilling a bore hole into the rock, said bore hole having a first diameter in communication with the opening of the bore hole and a second diameter along a top of the bore hole opposite the opening;

inserting a resin capsule into the bore hole;

inserting a shaft of a mining bolt into the bore hole, said shaft having a flange system disposed about the shaft in proximity to a first end thereof, said shaft having threads fixedly nonmovably attached to the shaft, said shaft having a first diameter smaller than the diameter of the bore hole such that there is a space between the shaft and the rock in which the bore hole is disposed;

puncturing the resin capsule with the shaft such that the resin flow down the bore hole in the space; and screwing the shaft into the rock along the second diameter of the bore hole such that threads of the shaft penetrate into the rock and the flange system abuts under tension the rock face.

* * * * *

UNITED STATES PATENT AND TRADEMARK OFFICE

CERTIFICATE OF CORRECTION

PATENT NO. : 5,114,278

DATED : May 19, 1992

INVENTOR(S) : Frank M. Locotos, Robert S. Bechtold

It is certified that error appears in the above-indentified patent and that said Letters Patent is hereby corrected as shown below:

In the abstract, line 12, replace "the" with -- a first -- .

Column 2, line 43, replace "the" with -- a first -- .

Column 2, line 56, after "proximity to", replace "the" with -- a first -- .

Column 3, line 2, replace "tenion" with -- tension -- .

Column 4, line 2, delete "A".

Column 4, line 4, delete "A".

UNITED STATES PATENT AND TRADEMARK OFFICE

CERTIFICATE OF CORRECTION

PATENT NO. : 5,114,278 Page 2 of 2

DATED : May 19, 1992

INVENTOR(S) : Frank M. Locotos, Robert S. Bechtold

It is certified that error appears in the above-indentified patent and that said Letters Patent is hereby corrected as shown below:

Column 5, line 18, delete "A".

Column 5, line 49, after "mining bolt" insert -- 10 -- .

Column 5, line 64, before "102" insert -- the first part -- .

Column 6, line 8, replace "par" with -- part -- .

Column 6, line 25, delete "0".

Column 8, line 21, replace "flow" with -- flows -- .

Signed and Sealed this

Twelfth Day of April, 1994

Bruce Lehman

*Attest:*

BRUCE LEHMAN

*Commissioner of Patents and Trademarks*

*Attesting Officer*